US005575681A

United States Patent [19]

Muzslay et al.

[11] Patent Number: 5,575,681

[45] Date of Patent: Nov. 19, 1996

[54] CONNECTOR TERMINATION TO FLAT CABLE

[75] Inventors: Steven Z. Muzslay, Huntington Beach; Michael S. Finona, Fountain Valley, both of Calif.

[73] Assignee: ITT Corporation, New York, N.Y.

[21] Appl. No.: 357,899

[22] Filed: Dec. 16, 1994

[51] Int. Cl.[6] ..... H01R 13/58

[52] U.S. Cl. ..... 439/459; 29/860

[58] Field of Search ..... 439/466, 676, 439/877, 585, 874, 459, 344, 418, 456; 29/860, 876, 879, 874, 875

[56] References Cited

U.S. PATENT DOCUMENTS

| | | | |
|---|---|---|---|
| 3,448,431 | 6/1969 | Adrien | 339/176 |
| 3,573,719 | 4/1971 | Lightner | 339/196 |
| 3,601,768 | 8/1971 | Lightner | 339/103 |
| 3,665,367 | 5/1972 | Keller et al. | 339/275 |
| 4,076,365 | 2/1978 | Ross et al. | 339/107 |
| 4,516,822 | 5/1985 | Wolfel | 439/459 |
| 4,602,831 | 7/1986 | Lockard | 339/14 |
| 4,607,905 | 8/1986 | Vaden | 439/676 |
| 4,618,202 | 10/1986 | Libregts et al. | 439/466 |
| 4,682,840 | 7/1987 | Lockard | 439/874 |
| 4,687,264 | 8/1987 | Shuey | 439/92 |
| 4,692,121 | 9/1987 | Arbogast, Jr. | 439/874 |
| 4,737,117 | 4/1988 | Lockard | 439/92 |
| 4,747,787 | 5/1988 | Siwinski | 439/108 |
| 4,824,384 | 4/1989 | Nicholas et al. | 439/108 |
| 4,852,252 | 8/1989 | Ayer | 29/860 |
| 4,879,809 | 11/1989 | Nicholas et al. | 29/860 |
| 4,920,642 | 5/1990 | Yanai et al. | 29/860 |
| 4,926,548 | 5/1990 | Hopkins et al. | 29/860 |
| 4,991,288 | 2/1991 | Scholz | 29/854 |
| 4,993,968 | 2/1991 | Guletsky et al. | 439/492 |
| 5,074,806 | 12/1991 | Korsunsky et al. | 439/497 |
| 5,114,366 | 5/1992 | Sato | 439/585 |
| 5,231,758 | 8/1993 | Schauer | 29/856 |
| 5,272,807 | 12/1993 | Henschen et al. | 29/863 |
| 5,288,242 | 2/1994 | Muzslay | 439/349 |
| 5,314,361 | 5/1994 | Ney et al. | 439/874 |
| 5,354,212 | 10/1994 | Bartle et al. | 439/459 |

*Primary Examiner*—Gary F. Paumen
*Assistant Examiner*—Eugene G. Byrd
*Attorney, Agent, or Firm*—Thomas L. Peterson

[57] ABSTRACT

Sheet metal contacts (20, FIG. 7) of a connector are terminated to conductors (16) of a flat ribbon cable in a highly secure joint for critical applications. The flat conductors of the cable lie facewise against flat rear ends of the contacts, within a connector housing rear portion. The housing rear portion has slots (46, 50) in its upper and lower walls for receiving welding electrodes to form weld joints (96) between the contacts and cable conductors.

9 Claims, 4 Drawing Sheets

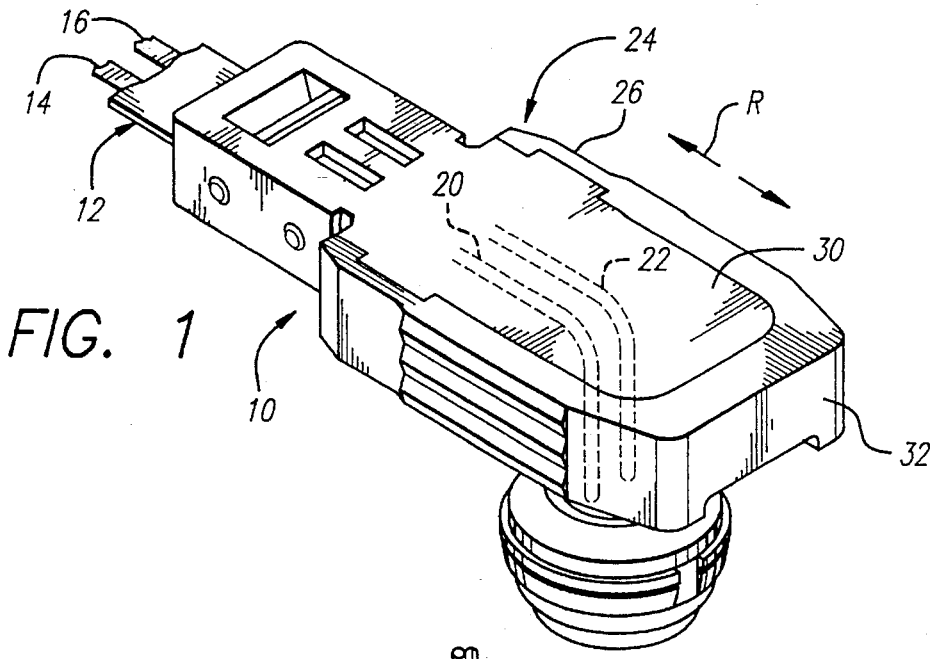
FIG. 1
FIG. 2
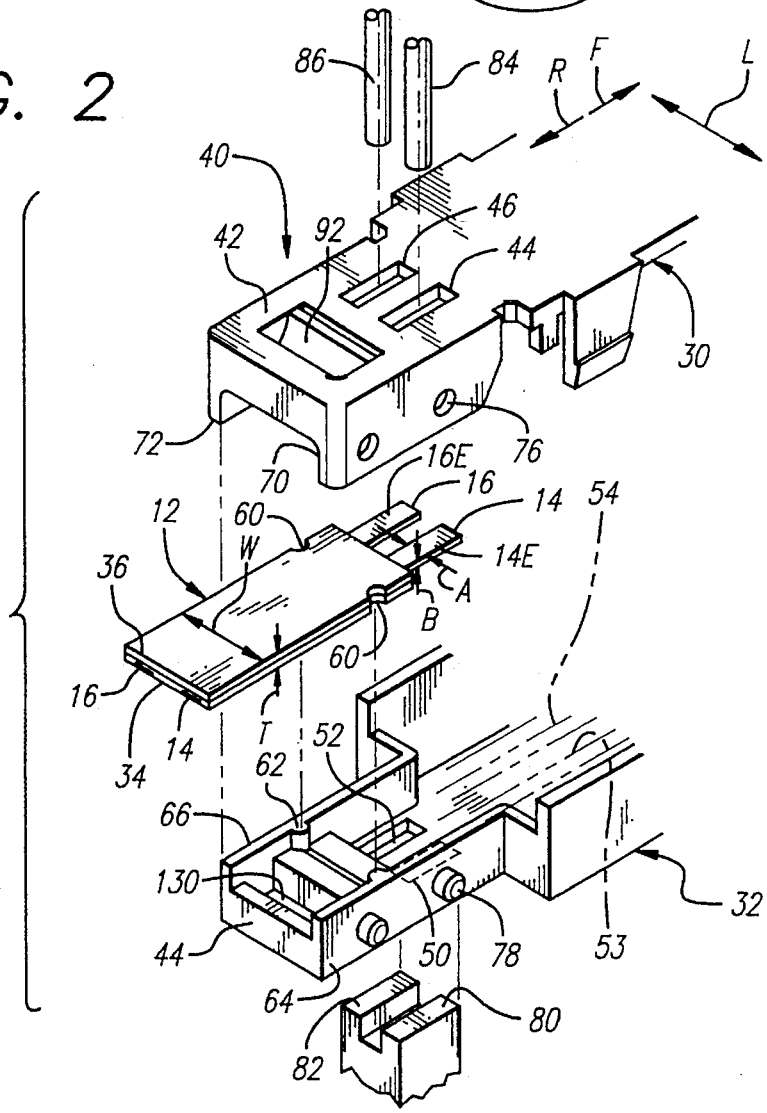

FIG. 3
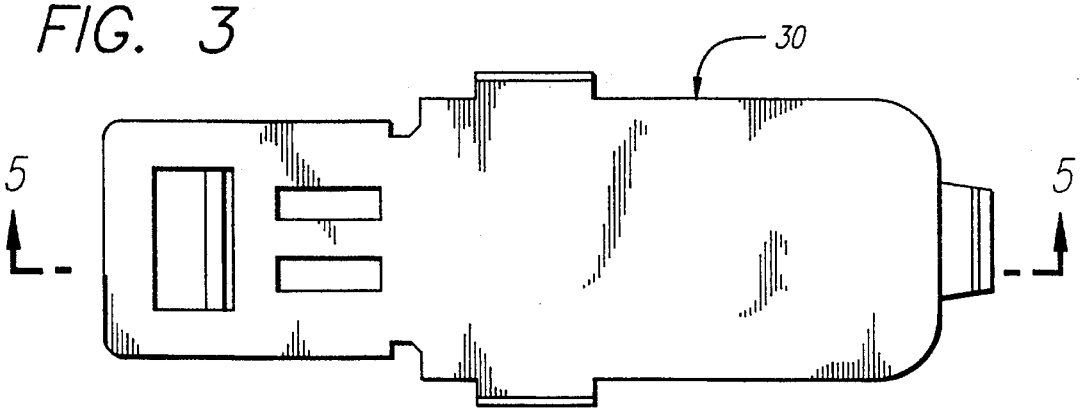
FIG. 4
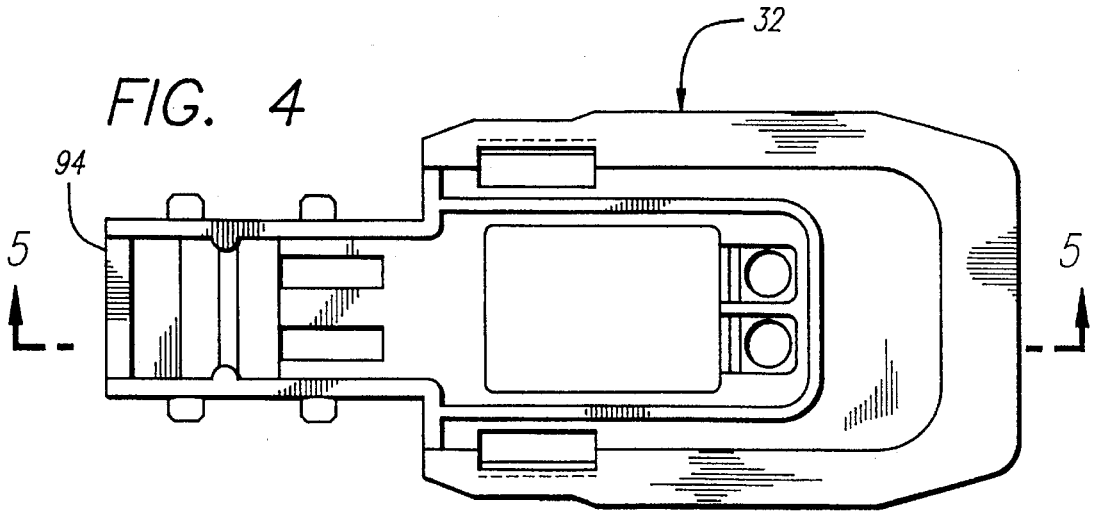
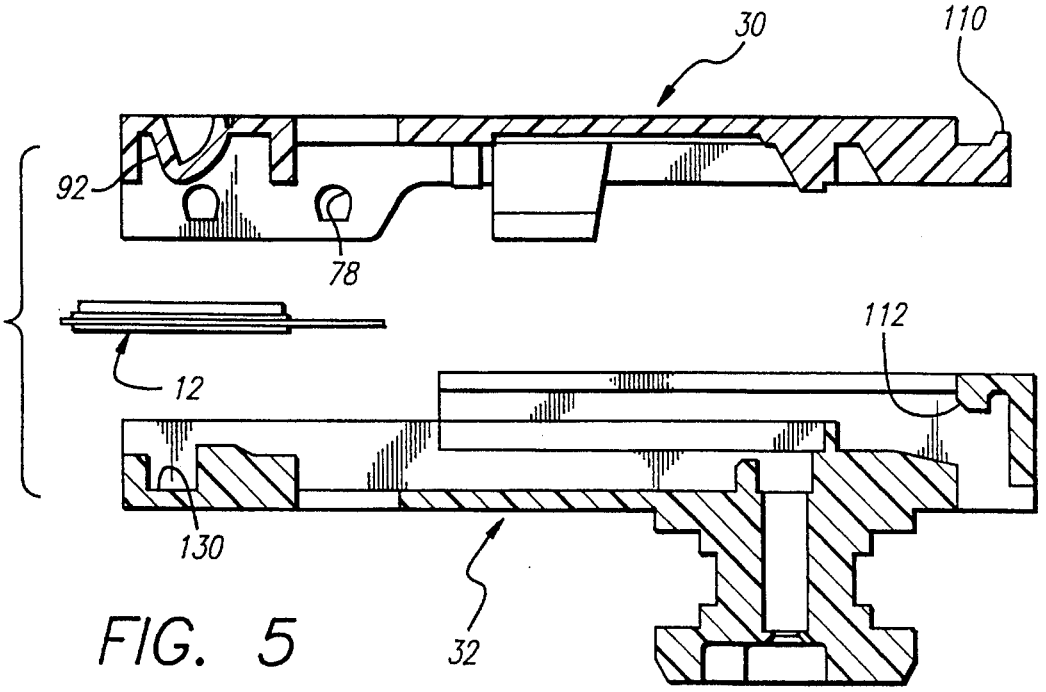
FIG. 5

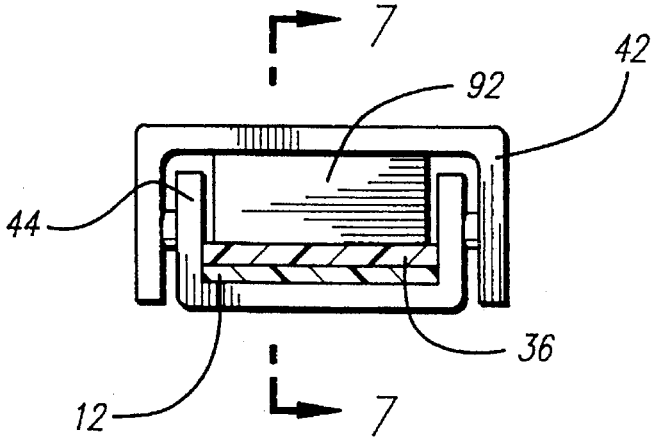
FIG. 6
FIG. 7
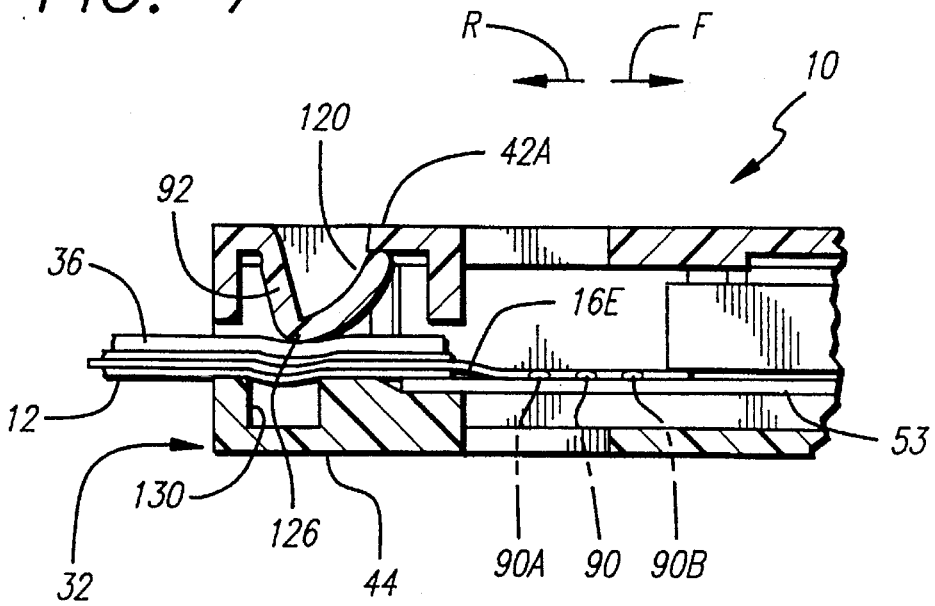

CONNECTOR TERMINATION TO FLAT CABLE

BACKGROUND OF THE INVENTION

Automobile air bags are inflated when an initiator circuit passes current to a squib. The initiator circuit is connected through a cable whose front end is terminated to contacts of a connector that are connected to the squib. My earlier U.S. Pat. No. 5,288,242 describes such a cable and connector assembly. Although the circuit may lay unused for years, it is critical that the electrical connections be intact during a possible crash, when the airbag must be deployed. As a result, the cable conductors must be very reliably terminated to the connector contacts. Since cost is of great importance in consumer products such as automobiles, the cable, connector, and termination method must be of low cost design.

SUMMARY OF THE INVENTION

In accordance with one embodiment of the present invention, an assembly of a connector and cable is provided which assures a highly reliable connection between the cable conductors and connector contacts while the contacts lie within the connector housing. The connector housing has a rear portion with upper and lower walls, with the walls having aligned through holes. The cable conductors have exposed front portions that lie facewise against rear portions of sheet metal contacts of the connector. The conductors and contacts are joined in a weld joint by the use of resistance welding electrodes that pass through the openings to sandwich the conductors and contacts between them and then pass current through them, the electrodes then being withdrawn.

The connector housing can have bumps received in cutouts at the edges of the cable for cable locating and for strain relief. Strain relief is further provided by a projection with a front end held up by a web that is broken to push down the projection and allow its front end to snap forward and resist upward movement.

The novel features of the invention are set forth with particularity in the appended claims. The invention will be best understood from the following description when read in conjunction with the accompanying drawings.

BRIEF DESCRIPTION OF THE DRAWINGS

FIG. 1 is a front and top isometric view of an assembly of a connector and cable constructed in accordance with one embodiment of the present invention.

FIG. 2 is a partial exploded isometric view of the assembly of FIG. 1, showing only the rear portion of the connector.

FIG. 3 is a plan view of the upper housing part of the connector of FIG. 3.

FIG. 4 is a plan view of the lower housing part of the connector of FIG. 3.

FIG. 5 is an exploded sectional view of the assembly as taken on lines 5—5 of FIGS. 3 and 4, and also showing, in phantom lines, a second embodiment of the invention.

FIG. 6 is a rear view of the connector of FIG. 2.

FIG. 7 is a view taken on the line 7—7 of FIG. 6.

DESCRIPTION OF THE PREFERRED EMBODIMENTS

Figure 8:
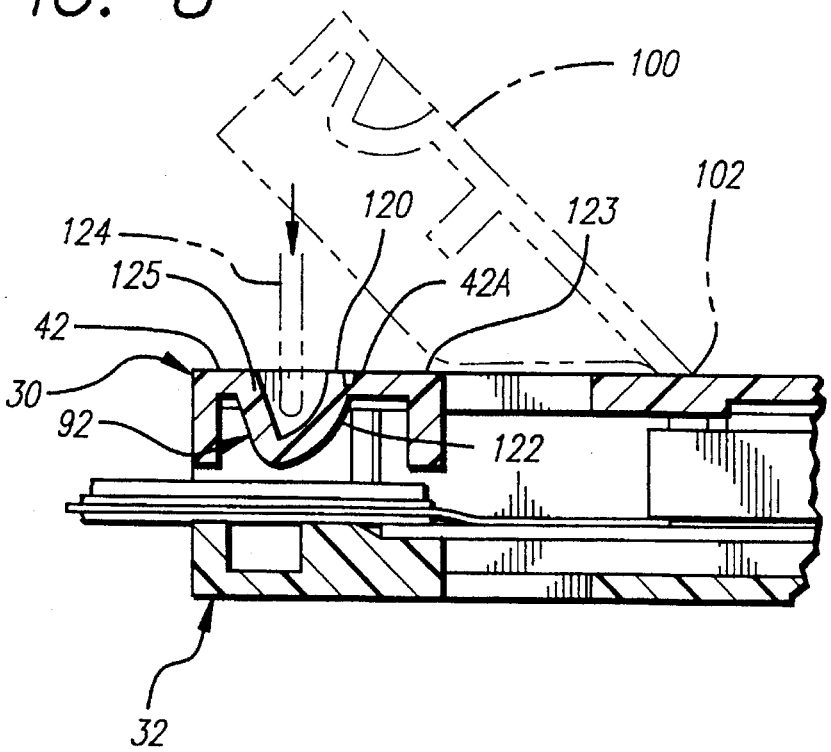
FIG. 8 is a view similar to that of FIG. 7, but prior to full assembly.

FIG. 1 illustrates an airbag cable and connector assembly 10 which includes a cable 12 with a rear end that is connected to an initiator circuit (not shown). The initiator circuit senses a crash and delivers a current through conductors 14, 16 of the cable and through contacts 20, 22 of the connector 24 to a squib that initiates burning of a propellant to inflate an airbag. The assembly is somewhat similar to that described in my earlier U.S. Pat. No. 5,288,242, wherein the cable includes round insulated wires, with the connector contacts being formed of sheet metal and crimped to the wires. With increased availability of high quality flat ribbon cables, applicant prefers to use such a cable 12 and terminate its conductors to the sheet metal contacts 20, 22 in a manner that provides even higher reliability of electrical connection of cable conductors to contacts.

The connector 24 includes a dielectric housing 26 with upper and lower housing parts 30, 32 that hold the contacts in place. As shown in FIG. 2, the cable includes insulation 34 that surrounds the cable conductors. Applicant prefers to employ a protective sheet 36 against the insulation, with the protective sheet having the same width and outline as the insulation. The insulation has a width W which is a plurality of times greater than its thickness T, and each of the conductors such as 14 has a width A which is a plurality of times greater than its thickness B. The housing has a rear portion 40 with upper and lower walls 42, 44, with a front portion of the cable being sandwiched between the walls and contacts in the final installation. The upper wall has a pair of through holes 44, 46, and the lower wall has a pair of corresponding through holes 50, 52. The holes in the upper and lower walls are aligned, in that at least a portion of each upper hole 44, 46 is in line with at least a portion of a corresponding lower hole 50, 52.

The sheet metal contacts (which are similar to those in my earlier patent) have rear portions 53, 54 which are flat and which lie over the holes 50, 52 in the lower wall 44. The cable is terminated by first laying it in place so exposed front portions or ends 14E, 16E lie on top of the contact rear portions 53, 54, which lie in alignment with the holes in the upper and lower walls. The insulation 34 of the cable, as well as the protective sheet 36 are formed with cutouts 60 that receive part-cylindrical bumps 62 formed in upstanding sides 64, 66 of the largely trough-shaped lower housing part. The cutouts 60 that receive bumps 62, maintain the position of the cable while also providing strain relief. Then, the upper housing part 30 is snapped in place over the lower housing part. The upper housing part is largely trough-shaped, with opposite sides 70, 72 depending from laterally (in directions L) opposite sides of the upper wall, and which move next to the sides 64, 66 of the lower housing part. The upper sides 70, 72 have apertures 76 which receive projections 78 on the; lower sides to keep the housing parts snapped together. After the cable has been trapped in place between the upper and lower housing parts, lower electrodes 80, 82 are projected upwardly through the holes 50, 52 in the lower wall while upper electrodes 84, 86 are projected down through the holes 44, 46 in the upper wall, until the contacts and conductors are sandwiched between the electrodes. Current is then passed between the electrodes to resistance weld each contact to a corresponding conductor.

FIG. 7 illustrates the final assembly 10, showing a resistance weld joint 90 between a contact rear end 53 and a conductor front portion 16E. The upper wall carries a downward projection 92 that presses the cable 12 into a recess 130 in the lower wall 44, to provide enhanced strain relief. The protective sheet 36 helps to protect the cable at this deformed location, as well as rearwardly of the connector, with the cable passing through an open rear end of the housing. It is often desirable to provide a plurality of weld joints, such as at 90A and 90B in addition to the joint 90. The elongated slots, whose lengths in the, forward-rearward directions F, R are preferably at least twice their widths in the lateral direction, facilitate such multiple welds.

The projection 92 is initially in the position shown in FIG. 8, with a front end 120 of the; projection connected through a thin web 122 to a main portion 123 of the upper wall at a retain location 42A. The projection 92 and upper wall main portion are integrally molded, with rear end 125 of the projection being bendable. A worker forces down the projection by pressing down a tool 124 to break the web 122. Once the projection 92 moves down to the position of FIG. 7, its front end 120 moves forward and snaps under the upper wall retain location 42A, which keeps the projection down.

FIG. 7 shows the front end 120 trapped under the upper wall location 42A, and with the middle or bottom 126 of the projection holding the cable depressed into the recess 130 in the lower housing part 32. The walls of the recess 130 and the projection 92, resist pullout of the cable. The bendable rear end 125 confines the projection to pivoting, while the projection front end 120 limits the pivot position in conjunction with location 42A.

FIG. 8 illustrates, in phantom lines at 100, an alternative upper housing part rear portion which is pivotally connected at a living hinge 102 to the rest of the upper housing portion. First, the cable is laid in the lower housing part 32. Then the pivotally connected part 100 is pivoted into place, and snapped in position by apertures (e.g. 76 in FIG. 2) in the portion 100 that receive projections on the lower housing part 32. Then, as shown in FIG. 7, the part 92 is pushed down. Then, the cable conductors and contacts are welded together. The embodiment shown in phantom lines in FIG. 8, allows the upper and lower housing parts and the contacts to be fully assembled by the connector manufacturer, with the customer having only to install the cable, pivot the hinged part, and make the welds.

For the upper housing part shown in solid lines at 30 in FIG. 5, the upper housing part has a forward lip 110 that is received within and hooked under a hook 112 at the front of the lower housing part. The upper housing part is then being pivoted about its lip so its rear end moves down until the apertures 78 receive corresponding projections.

Figure 9:
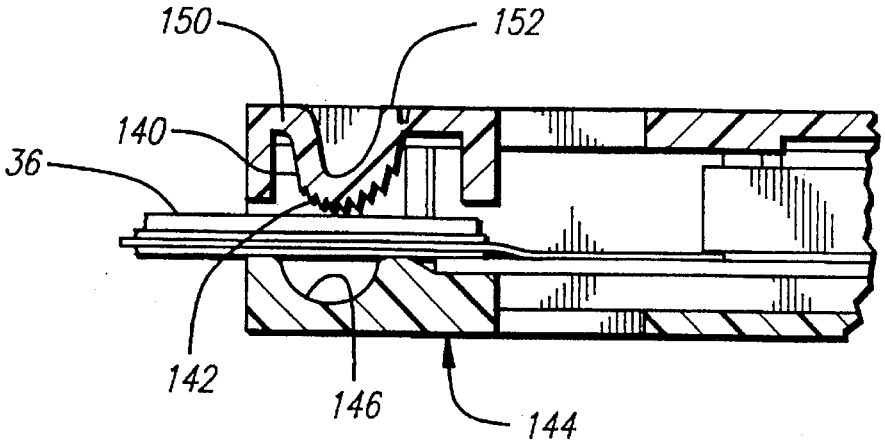
FIG. 9 is a partial sectional view of a connector of another embodiment of the invention, shown prior to full assembly to the cable.

FIG. 9 illustrates a modified connector with a bendable projection 140 that has teeth 142 that bite into the protective sheet 36. The lower housing part 144 forms a recess 146 that has a rounded concave shape, with a radius of curvature at least one-half of the projection length (between ends 150, 152). The concave recess 146 and convex projection 140 provide a large area where the recess walls engage the cable to provide high friction thereat.

While terms such as "upper" and "lower" have been used to aid in the description of the invention as illustrated, it should be realized that the assembly and its parts can be used in any orientation with respect to Earth's gravity.

Thus, the invention provides a connector with sheet metal contacts which are terminated in a highly reliable manner to conductors of a flat ribbon cable. Such termination is by weld joints between the cable conductors and connector contacts, with the weld joints made through openings in upper and lower walls at the rear of the connector through which welding electrodes can pass. The cable can have cutouts that receive bumps in connector sidewalls, and the cable and a protective sheet thereon can be locked in position by a projection depending from the upper wall which presses against the cable to press it into a recess in the lower wall. The projection can be flexible and have an end that snaps under an upper wall location to lock the latch down when it is forced down.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. An assembly of a connector and a cable, wherein the connector includes a housing having front and rear portions and at least one electrical contact having a contact rear portion lying in said housing rear portion, and wherein said cable includes at least one conductor having a front portion lying in said housing rear portion and connected in a joint to said contact rear portion, wherein:

said cable is a flat cable having a thickness and having a width that is a plurality of times greater than said thickness, with said conductor having a conductor thickness and having a conductor width that is a plurality of times greater than said conductor thickness;

said housing rear portion has upper and lower walls, with each of said walls having at least one through hole aligned with at least one through hole in the other wall;

said conductor front portion is welded to said contact rear portion at a location aligned with said through holes in said upper and lower walls.

2. The assembly described in claim 1 wherein:

said at least one contact includes two sheet metal contacts that each have flat contact rear portions, and said at least one conductor includes two conductors each joined to a different one of said contacts;

said housing rear portion includes two through holes in each of said upper and lower walls, with each hole in said upper wall being aligned with one of said holes in said lower wall;

said holes in said lower wall are each in the form of a slot which is elongated in a forward-to-rearward direction.

3. The assembly described in claim 2 wherein:

said conductor front portions are each welded to said contact rear portions at a plurality of locations that are spaced along the lengths of said slots.

4. The assembly described in claim 1 wherein:

said housing has upper and lower interfitting housing parts respectively forming said rear portion upper wall and said rear portion lower wall;

said lower housing part has a rear that is trough-shaped and that includes said lower wall and a pair of laterally spaced upstanding sides;

each of said sides includes a bump extending toward the other side;

said cable includes a layer of insulation with opposite insulation sides extending adjacent to said upstanding sides and with each insulation side having a cutout that receives one of said bumps;

said upper housing part has a downward projection lying rearward of said bumps and holding said cable against said lower wall.

5. The assembly described in claim 1 wherein:

said housing has upper and lower interfitting housing parts respectively forming said rear portion upper wall and said rear portion lower wall;

said lower housing part has a rear that is trough-shaped and that includes said lower wall and a pair of upstanding sides, and said upper housing part has a rear that is trough-shaped and that includes said upper wall and a pair of depending walls that have parts that snap against said upstanding sides;

said lower housing part has a front end with a downwardly projecting hook, and upper housing part has a lip that hooks under said hook and pivots therein to lower said rear of said upper housing part until said depending wall parts; snap against said upstanding sides.

6. An assembly of a connector and a cable, wherein the connector includes a housing having front and rear portions and a pair of electrical contacts that each has a contact rear portion lying in said housing rear portion, and wherein said cable includes a pair of conductors having a front portion lying in said housing rear portion and connected in a joint to said contact rear portions, wherein:

said cable is a flat cable having a thickness and having a width that is a plurality of times greater than its thickness, with each of said conductors having a conductor thickness and a conductor width that is a plurality of times greater than said conductor thickness;

said housing rear portion has upper and lower walls and has an open rear end, with said cable having a front portion projecting though said open rear end and with said conductors having exposed front ends that are devoid of insulation, said contacts are formed of sheet metal and have flat rear ends each lying facewise against one of said conductor exposed front ends and welded thereto, and said upper and lower walls each having at least one opening aligned with said joints.

7. The assembly described in claim 6 wherein:

said housing has upper and lower parts respectively forming said upper and lower walls, said lower part being largely trough-shaped and including a pair of upstanding lower sides at laterally opposite sides of said lower wall, and said upper part including a pair of depending sides at laterally opposite upper sides of said upper wall, with said lower sides lying between and engaging said upper sides, and with said upper side having a downward projection that has a smaller lateral width than the distance between said lower sides and which presses said cable against said lower wall at a location rearward of the location where said contacts are welded to said conductors.

8. A connector which has a housing with upper and lower housing parts, and with a space between portions of said housing parts for receiving a cable, wherein:

said upper housing part has an upper wall with a main part and with a downward projection, said projection having a rear end which is bendable with respect to said main part and said projection having a front end which can be moved down;

said upper wall main part has a retain location lying immediately forward of said projection front end, and said projection having a middle which can be moved down by downward bending of said projection to press down the cable and resist its rearward removal, with said projection front end snapping under said retain location when said middle is moved down to hold said projection in a downwardly bent position;

said projection extending in a downward loop between its front and rear ends with a concave upper surface and a convex lower surface, with said middle of said projection forming a loop middle that lies between and below said front and rear ends.

9. A method for constructing a connector with a dielectric housing and a pair of sheet metal contacts, and a cable with a pair of conductors, and for terminating said cable conductors to said contacts, comprising:

forming said cable as a flat cable with each of said conductors having flat top and bottom surfaces and having a width that is a plurality of times greater than its thickness, and stripping way insulation from a front end of said cable to leave exposed conductor front ends;

forming said connector housing with a rear portion that includes upper and lower walls, including leaving aligned holes in said upper and lower walls, and forming said contacts of sheet metal with rear contact ends that are flat and that lie between said holes in said upper and lower walls;

laying said cable on said lower wall with each of said exposed conductor front ends lying on one of said rear contact ends;

projecting upper and lower welding electrodes through said holes in said upper and lower walls and against said contacts and conductors, and passing current between said electrodes through each of said contacts and a corresponding one of said conductors to weld each contact to one of said conductors.

* * * * *